United States Patent [19]

Getner

[11] 4,064,993

[45] Dec. 27, 1977

[54] MULTI-PURPOSE STAND

[76] Inventor: Edwin S. Getner, 2549 Alveston Drive, Bloomfield Hills, Mich. 48013

[21] Appl. No.: 733,393

[22] Filed: Oct. 18, 1976

[51] Int. Cl.[2] ..... A47G 29/00

[52] U.S. Cl. ..... 211/85; 248/146; 248/165

[58] Field of Search ..... 248/146, 150, 151, 163, 248/165, 432, 440, 188, 188.7; 211/186, 188, 189, 194, 195, 71, 85; 108/111, 153, 156, 157, 159

[56] References Cited

U.S. PATENT DOCUMENTS

| | | | |
|---|---|---|---|
| 237,488 | 2/1881 | Conway | 248/146 X |
| 1,574,608 | 2/1926 | Cordley et al. | 248/150 |
| 1,603,233 | 10/1926 | Conwell et al. | 248/440 X |
| 1,619,818 | 3/1927 | Gowans | 211/189 X |
| 1,772,693 | 8/1930 | Van Dorin | 248/529 X |
| 2,250,361 | 7/1941 | Cullinan | 248/146 |
| 2,368,740 | 2/1945 | Blomgren | 248/165 |
| 3,312,438 | 4/1967 | Goetz et al. | 248/165 |
| 3,366,079 | 1/1968 | Koransky et al. | 108/157 |
| 3,875,873 | 4/1975 | Howitt | 248/165 X |
| 4,010,698 | 3/1977 | Taub | 108/111 |

FOREIGN PATENT DOCUMENTS

| | | | |
|---|---|---|---|
| 602,638 | 5/1948 | United Kingdom | 211/186 |

*Primary Examiner*—Roy D. Frazier
*Assistant Examiner*—Terrell P. Lewis
*Attorney, Agent, or Firm*—McGlynn and Milton

[57] ABSTRACT

A knockdown stand assembly for supporting a container or the like which is particularly adapted for use in a kit including a plurality of leg members, an intermediate retaining member for holding the leg members together at an intermediate point including openings for receiving the leg members, and an upper retaining member for holding the upper ends of the leg members together including openings for receiving the leg members, the leg members including locating sections for locating the intermediate retaining member and the upper retaining member relative to the leg members and releasable snap locks for locking the intermediate and upper retaining members in place. In kit form, the foregoing components are included with a container adapted to be supported by the knockdown stand assembly and a pedestal for providing an alternative means for supporting the container.

13 Claims, 14 Drawing Figures

MULTI-PURPOSE STAND

FIELD OF THE INVENTION

This invention relates to a knockdown stand assembly for supporting a container or other article. The knockdown stand assembly is particularly suited for inclusion in a kit which includes the components of the knockdown stand assembly, a container adapted to be supported by the knockdown stand assembly and a pedestal for alternatively supporting the container.

BACKGROUND OF THE INVENTION

This invention relates to stands of the type which are employed to support an ice bucket, planter or similar containers. Currently available stands of this type are made of metal wherein the individual components are welded together or fastened by threaded fasteners. In other words, they comprise permanent assemblies which are difficult or impossible to dismantle for storage purposes. Since with the exception of restaurants and the like, a stand for supporting an ice bucket is used on a periodic basis, the types of stands presently available are impractical for private use.

In addition to the foregoing, currently available stands of this type are rather expensive. This is due in great part to the fact that such stands are made of metal, such as stainless steel or the like. The design of the instant invention permits the use of less costly plastic materials, such as polystyrene, which results in a less expensive lightweight stand. The unique design of the knockdown stand combines the required functional features in an aesthetic manner to produce a stand of exceptional utility and pleasing appearance.

In one application of the invention, the components of the knockdown stand are included in a kit which also includes a container adapted to be supported by the knockdown stand and a pedestal for alternatively supporting the container. Hence, the components of the kit can be used for a variety of purposes.

BRIEF SUMMARY OF THE INVENTION

The knockdown stand assembly of the instant invention includes a plurality of legs, preferably three, an intermediate retaining member including openings for receiving the leg members, and an upper retaining member including openings which are also adapted for receiving the leg members. The leg members include locating means for locating the intermediate retaining member and the upper retaining member relative to the leg members to thereby hold the leg members together at an intermediate point and at their upper ends. The leg members also include releasable snap locks for locking the intermediate and upper retaining members in place.

When manufactured in the form of a kit, the kit preferably includes the above-mentioned five components of the knockdown stand as well as a container adapted to be supported by a knockdown stand and a pedestal for alternatively supporting the container. It is intended that the kit be sold in a disassembled form for subsequent assembly by the user.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
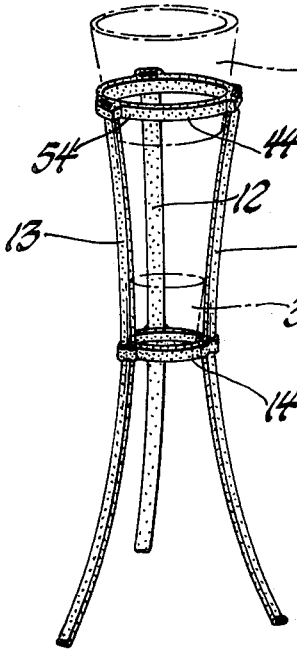
FIG. 1 is a perspective view of a knockdown stand constructed in accordance with the instant invention.

Referring more particularly to the drawings, a knockdown stand constructed in accordance with the instant invention is generally shown at 10 in FIG. 1.

Figure 2:
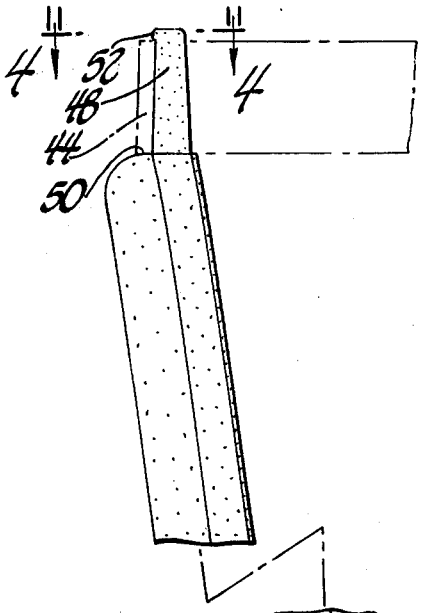
FIG. 2 is a plan view of the five diassembled components of the knockdown stand.
Figure 2:
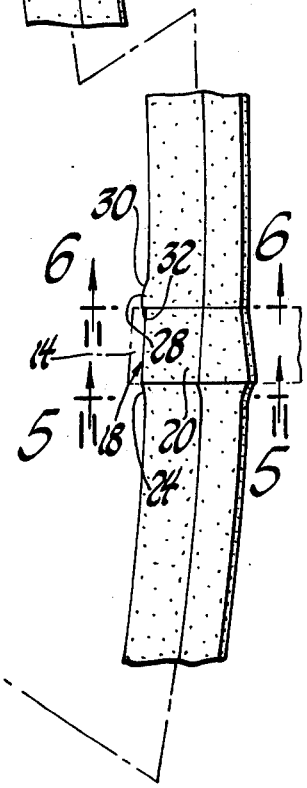
Figure 2:
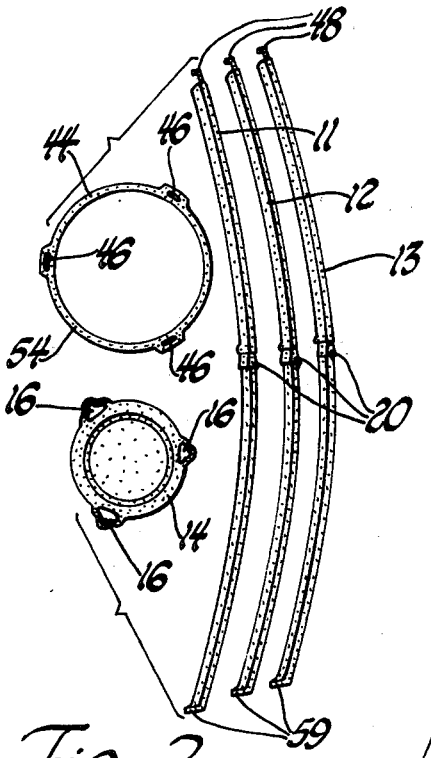
Figure 5:
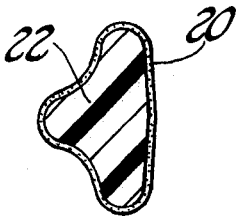
FIG. 5 is a view taken generally along line 5—5 of FIG. 3.
Figure 6:
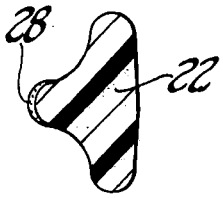
FIG. 6 is a view taken generally along line 6—6 of FIG. 3.
Figure 8:
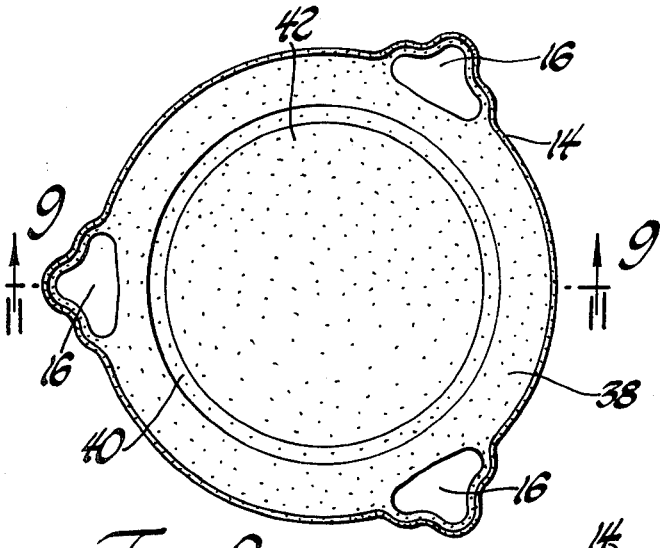
FIG. 8 is a plan view of the intermediate retaining member of the knockdown stand.

The knockdown stand assembly 10 includes three leg members 11, 12 and 13. The leg members are held together at an intermediate point by an intermediate retaining member 14 which, as shown in FIGS. 2 and 8, includes three symmetrically located openings 16 for receiving the leg members 11, 12 and 13. The leg members 11, 12 and 13 are generally T-shaped in transverse cross section as shown in FIGS. 5 and 6. It is noted, however, that other shapes may be employed. Due to the fact that the leg members 11, 12 and 13 are T-shaped in transverse cross section, the openings 16 in the intermediate retaining member 14 have a similar shape.

Figure 3:
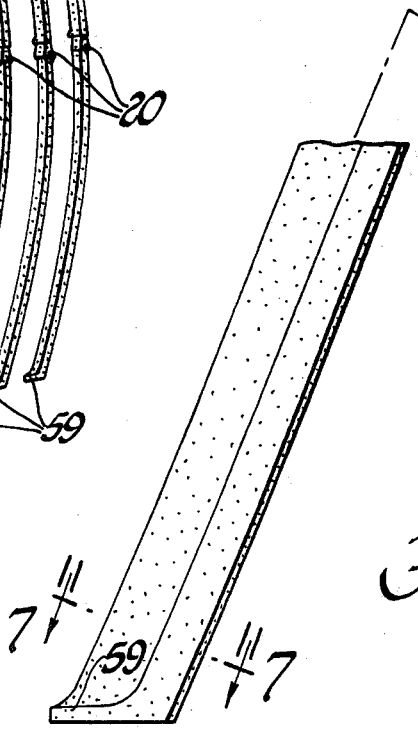
FIG. 3 is an elevational view of one of the leg members of the knockdown stand.
Figure 9:
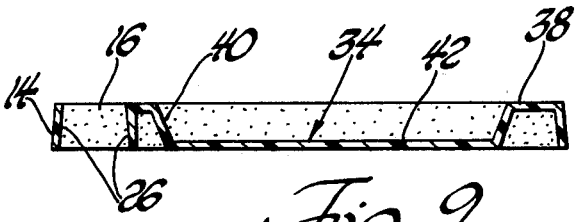
FIG. 9 is a view taken generally along line 9—9 of FIG. 8.
Figure 10:
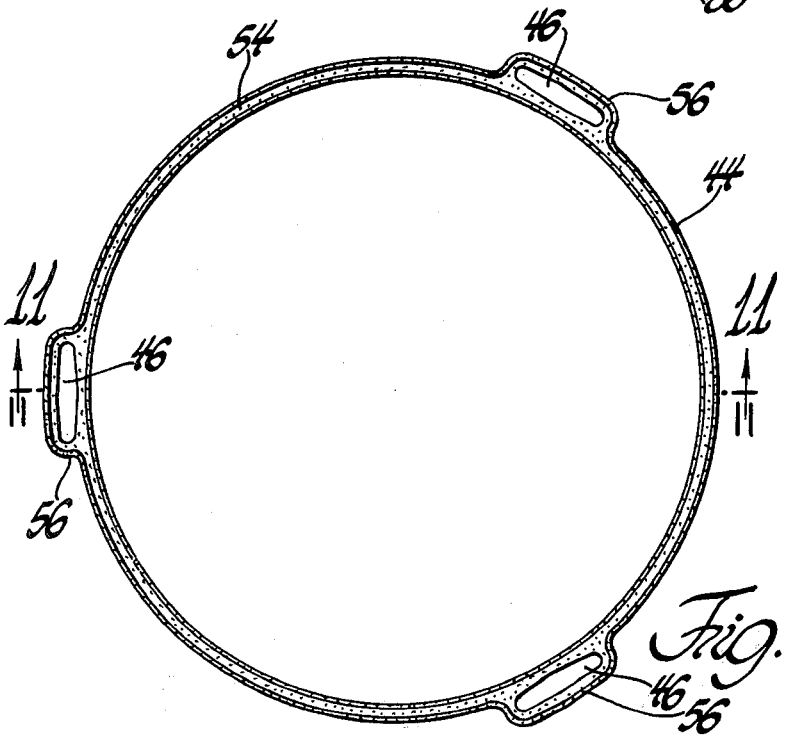
FIG. 10 is a plan view of the upper retaining member of the knockdown stand.
Figure 11:
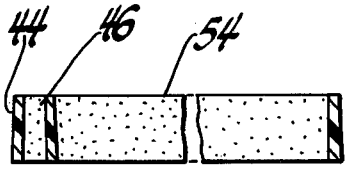
FIG. 11 is a view taken generally along line 11—11 of FIG. 10.
Figure 14:
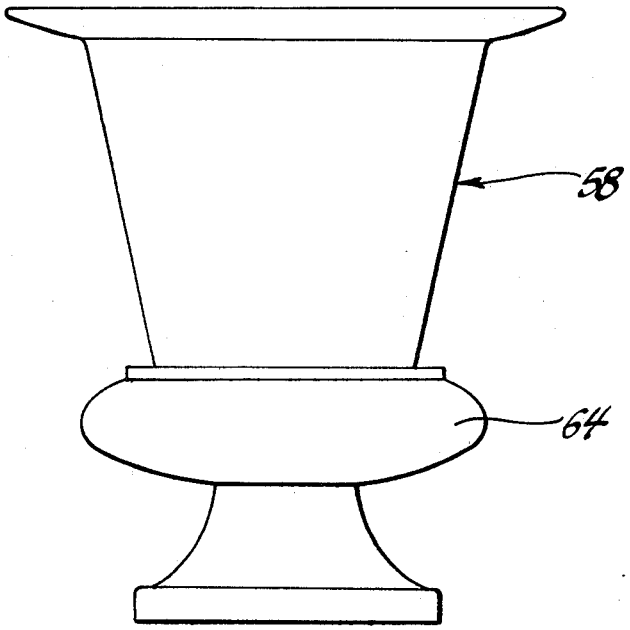
FIG. 14 is an elevational view of the container component supported by the pedestal component.

In order to establish a connection between the leg members 11, 12 and 13 and the intermediate retaining member 14, the leg members include locating means, generally indicated at 18 in FIG. 3, for locating the intermediate retaining member 14. The locating means 18 consists of a wedge-shaped enlarged section 20. As shown in FIGS. 3 and 5, the wedge-shaped enlarged section is formed by abruptly increasing the size of the standard cross section 22 of the leg thereby forming a shoulder 24. The sides of the leg member are then tapered upwardly and inwardly until the standard cross section is again established. As shown in FIG. 3, the length of the tapered section is approximately equal to the thickness of the intermediate retaining member 14. The openings 16 in the intermediate retaining member 14, as shown in FIG. 9, include upwardly tapered walls 26 which correspond to the taper of the wedge-shaped enlarged section 20. Hence, the walls of the openings 16 in the intermediate retaining member 14 snugly engage and seat on the wedge-shaped enlarged sections 20.

In order to assemble the three leg members 11, 12 and 13 to the intermediate retaining member 14, the upper ends of the leg members are fed through the openings 16. The intermediate retaining member 14 is moved down the legs until the holes 16 register with the enlarged sections 20. At this position a mechanical interference is established which prevents the intermediate retaining member 14 from moving farther down the legs.

The intermediate retaining member 14 is releasably locked in place by releasable snap lock means which preferably consists of a projection 28 on each of the leg members. As shown in FIG. 6, the projection 28 comprises a small extension on the end of the middle branch of the T-shaped leg. The projection 28 is located above the wedge-shaped enlarged section 20 so that it snaps over the top of the intermediate retaining member 14 when it is properly seated on the wedge-shaped enlarged section 20. As shown in FIG. 3, the projection 28 consists of a sloped surface 30 which forms a ramp and an undercut 32 which forms a shoulder. Since the components of the knockdown stand are preferably made of a plastic material, there is sufficient resilience in the parts to permit the intermediate retaining member 14 to pass beyond the projection 28, the projection 28 snaps over the intermediate retaining member 14 so that the shoulder 32 holds the intermediate retaining member 14 in place.

The intermediate retaining member 14 includes a support surface, generally indicated at 34 in FIG. 9, for supporting an article, such as a planter 36 as shown in FIG. 1. The support surface 34 is formed by an annular section 38 in which the openings 16 are formed. An integral dish-shaped member having walls 40 and a floor 42 is formed integrally with the annular portion 38 thereby defining the support surface 34.

Figure 4:
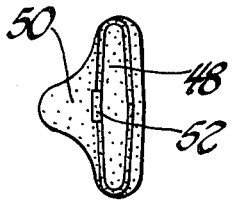
FIG. 4 is a view taken generally along line 4—4 of FIG. 3.

The knockdown stand assembly 10 further includes an upper retaining member 44 for holding the upper ends of the leg members 11, 12 and 13 together. The upper retaining member 44 includes openings 46 for receiving the ends of the leg members. The leg members 11, 12 and 13 include locating means for locating the upper retaining member 44. The locating means consists of tongue members 48 formed on the upper ends of the leg members. The tongue members 48 are of a suitable size and shape to fit in the openings 46 in the upper retaining member 44. As shown in FIG. 4, the tongue member 48 is smaller in its overall dimension than the cross section of the leg member. A shoulder 50 is thus formed around the base of the tongue member 48 against which the upper retaining member 44 abuts. The shoulder 50 prevents the upper retaining member 44 from moving farther down the legs.

In order to releasably lock the legs to the upper retaining member 44, the tongue members 48 are provided with releasable snap lock means consisting of projections 52 which extend laterally from the tongues 48. The projections 52 snap over the top of the upper retaining member 44 to hold it in place. Again, due to the resiliently deformable nature of the material used to make the stand components, the projection 52 can be forced through the opening 46 until it snaps over the top. It is noted here that the dimensions of the projections 28 and 52 are somewhat exaggerated to show the manner in which they function. It is to be recognized that these projections may be reduced in size and still produce a releasable connection.

The upper retaining member 44 comprises an annular section or ring 54 having three enlarged portions 56 in which the openings 46 are formed. The annular section 54 is adapted to receive and support a container, such as an ice bucket or planter 57. The container 57 is supported by the annular section 54 because the container 57 has sides which taper between an upper diameter which is larger than the diameter of the annular section 54 and a lower diameter which is smaller than the diameter of the annular section 54. Thus, the container 57 will seat itself in the annular section 54 when the outer diameter of the container 57 approximately equals the inner diameter of the annular section 54. Alternatively, the container 57 may include a flange or lip on its rim which overlies the annular section 54 thereby supporting the container 57.

Figure 7:
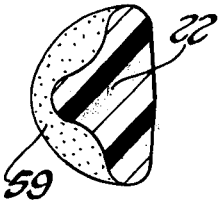
FIG. 7 is a view taken generally along line 7—7 of FIG. 3.

The legs 11, 12 and 13 also include foot portions 59 for engaging a support surface. As shown in FIGS. 3 and 7, the foot portions 59 are larger than the standard cross section 22 of the leg members. This feature provides an increased surface of contact with the support surface thereby increasing stability. Additionally, the enlarged foot portions 59 prevent misassembly of the legs to the intermediate retaining member 14. This is due to the fact that it is imposible to insert the lower ends of the legs 11, 12 and 13 through the openings 16 in the intermediate retaining member 14. Therefore, the only way in which the legs can be assembled to the intermediate retaining member 14 is to insert the upper ends of the legs through the openings 16.

Figure 12:
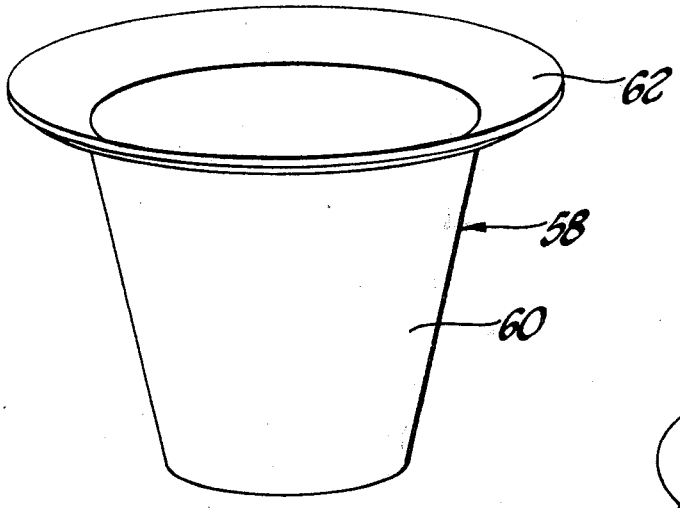
FIG. 12 is a perspective view of the container component of the kit in accordance with the instant invention.

The knockdown stand assembly 10 is particularly suited to be manufactured and sold in a disassembled form for subsequent assembly by the user. In other words, the knockdown stand assembly 10 can be manufactured in the form of a kit. In addition to the five components of the knockdown stand, the kit includes a container 57, as shown in FIG. 1, or the container 58, as shown in FIG. 12, both of which are designed to be supported by the knockdown stand assembly 10. More specifically, the body 60 of the container 58 is tapered and has a size which does not exceed the inner diameter of the upper retaining member 44. The container 58 further includes a lip or flange 62 which seats upon the upper retaining member 44 thereby supporting the container body 60.

Figure 13:
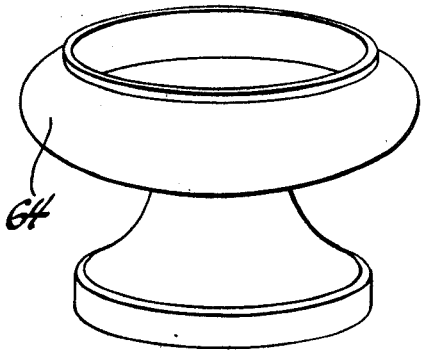
FIG. 13 is a perspective view of the pedestal component of the kit in accordance with the instant invention.

In the event that the knockdown stand assembly 10 is being employed for supporting a container other than container 58, the kit also includes a pedestal 64, as shown in FIG. 13, for providing an alternative means for supporting the container 58. These seven elements, that is, the three legs 11, 12 and 13, the intermediate retaining member 14, the upper retaining member 44, the pedestal 64 and the container 58 comprise the elements of a kit for supporting the container.

It is also intended that the components of the knockdown stand assembly 10 be made of a plastic material, such as polystyrene. A plastic knockdown stand assembly offers significant advantages over permanent metal stands. The knockdown stand is significantly less expensive, it is lightweight, yet durable and is uniquely suited for achieving the knockdown characteristic. Since it is contemplated to manufacture the individual components out of plastic, for example, by means of an injection-molding process, features of these various components are intentionally designed to include tapers to permit separation of the injection-molding dies. For example, the openings 16 in the intermediate retaining member 14 are tapered. From the preceeding discussion it should be recognized that the tapered openings 16 serve a dual purpose. Primarily, the tapered openings 16 are designed to register with the wedge-shaped enlarged sections 20 of the leg members. Additionally, however, the tapered walls of the openings 16 are desirable for purposes of designing the appropriate injection molds. It is noted that other walls of the intermediate retaining member 14 and the walls of the upper retaining member 44 are also tapered for this same reason.

The invention has been described in an illustrative manner, and it is to be understood that the terminology which has been used is intended to be in the nature of words of description rather than of limitation.

Obviously, many modifications and variations of the present invention are possible in light of the above teachings. It is therefore, to be understood that the invention may be practiced otherwise than as specifically described herein and yet remain within the scope of the appended claims.

The embodiments of the invention in which an exclusive property or privilege is claimed are defined as follows:

1. A knockdown stand assembly comprising: a plurality of leg members, an intermediate retaining member including openings for receiving said leg members for holding said leg members together at an intermediate point and an upper retaining member including openings for receiving said leg members for holding the upper ends of said leg members together; said leg members including an upper portion having cross-sectional dimensions capable of pasage through said openings in said intermediate retaining member, locating means for locating said intermediate retaining member and said upper retaining member relative to said leg members, said locating means for said intermediate retaining member comprising an enlarged section having a cross-sectional dimension greater than that of said opening in said intermediate retaining member to prevent further passage of said leg member and releasable snap lock means for locking said intermediate and upper retaining member in place.

2. An assembly as set forth in claim 1 wherein said enlarged section is wedge-shaped and said openings in said intermediate retaining member include tapered walls for snugly engaging said wedge-shaped enlarged section.

3. An assembly as set forth in claim 2 wherein said releasable snap lock means for said intermediate retaining member includes a projection located above said wedge-shaped enlarged section.

4. An assembly as set forth in claim 3 wherein said locating means for said upper retaining member includes a tongue member on the upper end of each of said leg members, said openings in said upper retaining member having a corresponding shape to receive said tongue members.

5. An assembly as set forth in claim 4 wherein said releasable snap lock means for said upper retaining member includes a projection located on said tongue member for snapping over said upper retaining member.

6. An assembly as set forth in claim 5 wherein said leg members are generally T-shaped in transverse cross section.

7. An assembly as set forth in claim 5 wherein said intermediate retaining member includes a support surface for supporting an article.

8. An assembly as set forth in claim 5 wherein said upper retaining member includes an annular section for supporting a container.

9. An assembly as set forth in claim 5 wherein each of said leg members includes a foot portion for engaging a support surface, said foot portions for engaging a support surface, said foot portions being larger than said openings in said intermediate retaining member.

10. A knockdown stand assembly comprising: three leg members, an intermediate retaining member including three symmetrically located openings for receiving said leg members, and an upper retaining member including three symmetrically located openings for receiving said leg members; said leg members including a wedge-shaped enlarged section intermediate the ends thereof for locating said intermediate retaining member, said openings in said intermediate retaining member including tapered walls for snugly engaging said wedge-shaped enlarged section, a projection located above said wedge-shaped enlarged section for releasably locking said intermediate retaining member in place, said leg members further including a tongue member located on the upper ends thereof, said openings in said upper retaining member having a corresponding shape to receive said tongue members and a projection located on the tongue members for snapping over said upper retaining member to releasably lock said member in place.

11. An assembly as set forth in claim 10 wherein said upper retaining member includes an annular section for supporting a container.

12. An assembly as set forth in claim 10 wherein said intermediate retaining member includes a support surface for supporting an article.

13. A kit for a multi-purpose knockdown stand comprising: a plurality of leg members, an intermediate retaining member including openings for receiving said leg members, an upper retaining member including an annular section and openings in said annular section for receiving said leg members, said leg members including an upper portion having cross-sectional dimensions capable of passage through said openings in said intermediate retaining member, locating means for locating said intermediate retaining member and said upper retaining member relative to said leg members said locating means for said intermediate retaining member comprising an enlarged section having a cross-sectional dimension greater than that of said opening in said intermediate retaining member to prevent further passage of the leg member and releasable snap lock means for locking said intermediate and upper retaining members in place, and a container adapted to be supported by said upper retaining member.

* * * * *

UNITED STATES PATENT OFFICE

CERTIFICATE OF CORRECTION

PATENT NO. : 4,064,993

DATED : December 27, 1977

INVENTOR(S) : Edwin S. Getner

It is certified that error appears in the above-identified patent and that said Letters Patent are hereby corrected as shown below:

Column 3, line 25, after "projection", first occurrence, insert --28 with the aid of the sloped surface 30. When the intermediate retaining member 14 passes beyond the projection--.

Column 6, Claim 9, line 4, "said foot portions for engaging a support surface," should be deleted.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*